US005190330A

United States Patent [19]

Dunham

[11] Patent Number: 5,190,330

[45] Date of Patent: Mar. 2, 1993

[54] TOOL FOR CONNECTING A SNAP-HOOK TO A REMOTE EYE

[76] Inventor: Bill Dunham, 8067 NE. Juanita Dr., Kirkland, Wash. 98034

[21] Appl. No.: 863,407

[22] Filed: Apr. 3, 1992

[51] Int. Cl.[5] ..... B25J 1/00; B63B 21/54

[52] U.S. Cl. ..... 294/19.1; 114/221 R

[58] Field of Search ..... 294/19.1, 22-24, 294/82.27; 114/221 R, 230

[56] References Cited

U.S. PATENT DOCUMENTS

| | | | |
|---|---|---|---|
| 1,199,690 | 9/1916 | Gillan . | |
| 1,281,336 | 10/1918 | Frazier, Jr. | 114/230 |
| 1,852,629 | 4/1932 | Sturges | 294/19.1 X |
| 1,932,099 | 10/1933 | Cabana | 294/19.1 X |
| 2,979,013 | 4/1961 | Whittall | 114/221 R X |
| 3,098,462 | 7/1963 | Holzman | 114/221 R X |
| 3,273,928 | 9/1966 | Wisniewski | 294/19.1 X |
| 3,733,097 | 5/1973 | Hank, Jr. | 294/19.1 |
| 3,913,515 | 10/1975 | Hernsjo et al. | 294/19.1 |
| 4,595,223 | 6/1986 | Hawie | 294/19.1 |
| 4,932,700 | 6/1990 | Hart | 294/19.1 |
| 4,986,207 | 1/1991 | Reed | 294/19.1 X |

FOREIGN PATENT DOCUMENTS

| | | | |
|---|---|---|---|
| 2606732 | 5/1988 | France | 294/19.1 |

*Primary Examiner*—Johnny D. Cherry
*Attorney, Agent, or Firm*—Delbert J. Barnard

[57] ABSTRACT

A snap-hook (34) is set into a hook channel portion (68, 70, 72) of a hook holder (40). The hook holder (40) is secured to one end of an elongated handle (38). A holding arm (76) is pivotally (by bolt 84) attached to the hook holder (40) and holding arm (76) includes a hook (86) which engages (at 88) the snap finger (48) of the hook (34). A finger (90) extends from hook holder (40) into the eye (44) of the snap-hook (34). A user (U) picks up the handle (38) distal the hook holder (40) and uses the handle (38) to move the hook (34) into engagement with a bow eye (28) or the like. Contact of the bow eye (28) and the snap finger (48) moves the holding arm (76) out of holding engagement with the snap finger (48). The bow eye (28) enters into the hook throat (52). The hook (34) becomes engaged with the bow eye (28). The hook (34) also becomes free from the holding arm (76). This allows easy movement of the hook holder (40) away from the hook (34).

4 Claims, 5 Drawing Sheets

TOOL FOR CONNECTING A SNAP-HOOK TO A REMOTE EYE

TECHNICAL FIELD

This invention relates to a tool for attaching a line hook to a remote eye, such as the bow eye on a boat, for example. More particularly, it relates to the provision of such a tool characterized by a hook holder and guide elements associated with the hook holder, adapted for guiding the hook into proper engagement with the remote eye.

BACKGROUND INFORMATION

The patent literature includes a number of tools for moving a line hook into engagement with a remote eye. Example tools for this purpose are disclosed by U.S. Pat. No. 2,979,013, granted Apr. 11, 1961 to James T. Whittall; U.S. Pat. No. 3,098,462, granted Jul. 23, 1963 to James W. Holzman; U.S. Pat. No. 3,273,928, granted Sep. 20, 1966 to Vladimir M. Wisniewski; U.S. Pat. No. 3,733,097, granted May 15, 1973 to Aaron J. Hank, Jr.; U.S. Pat. No. 4,595,223, granted Jun. 17, 1986 to Robert L. Hawie and U.S. Pat. No. 4,923,700, of the present invention is to provide an improved tool for connecting a line hook to a remote eye, such tool including a hook support and guide structure adapted to facilitate connection of the hook to the eye and facilitate removal of the tool from the hook following hook/eye engagement.

My copending application Ser. No. 07/817,133, filed Jan. 6, 1992, and entitled TOOL FOR CONNECTING A LINE HOOK TO A REMOTE EYE, is incorporated herein by this reference.

DISCLOSURE OF THE INVENTION

The hook holder of the invention is basically characterized by an upwardly opening channel in which a snap-hook is received, with its snap finger and throat directed generally upwardly and with the snap-hook extending substantially perpendicular to the bow eye.

The hook holder includes a bottom bounded on one side by a sidewall and on an opposite side by side barriers. The bottom, the sidewall and the side barriers define a channel in which the back portion of the snap-hook is received. A holding arm is pivotally attached to the sidewall. The holding arm includes a hook portion which is positionable above the snap finger of the snap-hook. This hook portion includes a hook recess in which the snap finger is received. The hook recess engages the snap finger of the snap-hook and the channel engages the back portion of the snap-hook. In this manner, the snap-hook is restrained against sideways movement out from the hook holder. In preferred form, a holding finger extends laterally from the sidewall of the hook holder over the bottom. This holding finger is positioned to extend into the eye of the snap-hook when the snap-hook is being held by the holding arm and the channel. The holding finger prevents endwise movement of the snap-hook along the channel.

According to the invention, the hook holder and the snap-hook move towards a remote eye, e.g. a bow eye on a boat. The snap-hook is moved towards the bow eye, with the bow eye moving against the snap finger. The bow eye bends the snap finger inwardly and in the process moves it out of engagement with the holding arm. The holding arm then pivots in position, to allow the remote eye to enter into the throat of the snap-hook.

After the remote eye clears the snap finger, the snap finger moves into a throat closing position. The snap-hook is still within the channel but it is no longer being held by the holding arm. As a result, the user can move the hook holder away from the snap-hook, leaving the snap-hook engaged with the remote eye.

In preferred form, the holding arm is adjustably mounted onto the sidewall of the hook holder so that it can be repositioned to adapt the hook recess of its hook arm to fit different size snap-hooks.

Other features, objects and advantages of the invention are hereinafter described in the description of the best mode.

BRIEF DESCRIPTION OF THE DRAWINGS

Like reference numerals are used to designate like parts throughout the several views of the drawing, and.

BEST MODE FOR CARRYING OUT THE INVENTION

Figure 1:
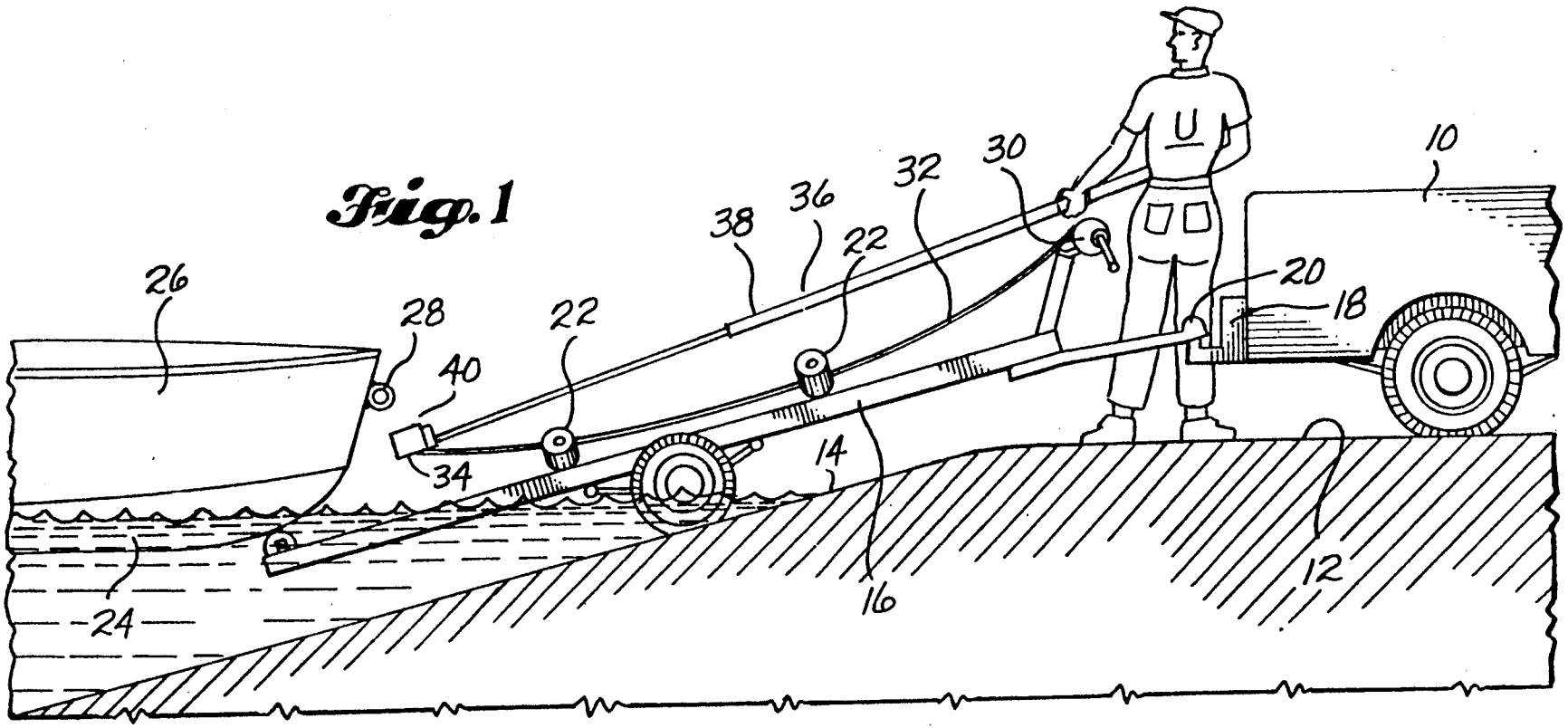
FIG. 1 is a side elevational view showing a boat in a body of water with its bow adjacent the rear end of a boat trailer, and showing a person standing adjacent a winch that is located at the front end of the trailer, such person holding a tool which embodies the invention and in the process of using such tool for moving a snap-hook into engagement with a bow eye on the boat, said snap-hook being connected to the aft end of a line which extends rearwardly from the winch.

Referring to FIG. 1, a vehicle 10 is shown parked at the upper end 12 of a boat ramp 14. A conventional boat trailer 16 is connected to the vehicle 10. Vehicle 10 includes a trailer hitch 18 and the boat trailer 16 includes a trailer hitch coupler 20 which is connected to the trailer hitch 18. Trailer 16 includes rollers 22 supported on a trailer bed and adapted to make contact with bottom 24 of boat 26. Boat 26 includes a vertically oriented bow eye 28. A winch 30 is provided at the forward end of trailer 16. A line 32 extends rearwardly from winch 30 and includes a snap-hook 34 at its rear end. As will become apparent, tool 36 allows a user U to stand adjacent the winch 30 and from that position connect the snap-hook 34 to the bow eye 28. Tool 36 includes an elongated handle or pole 38 which is preferably a telescopic handle, so that its length is adjustable. Tool 36 includes a forward end and a hook holder 40 at the forward end. Hook holder 40 will now be described, with reference to FIGS. 2–10.

Snap-hook 34 includes a hook eye 44, a curved tine 46 and a snap finger 48. Hook eye 44 serves to connect the snap-hook 34 to the end of line 32 distal the winch 30. Hook tine 46 includes a free end portion 50 which is spaced across a hook throat 52 from the hook eye 44. In a manner known per se, snap finger 48 extends across and closes the hook throat 52. Snap finger 48 can be swung inwardly, to open the hook throat 52. Contact between snap finger 48 and the free end 50 of tine 46 (FIG. 7) prevents outward movement of the snap finger 48, beyond the throat closing position shown in FIG. 7.

Figure 7:
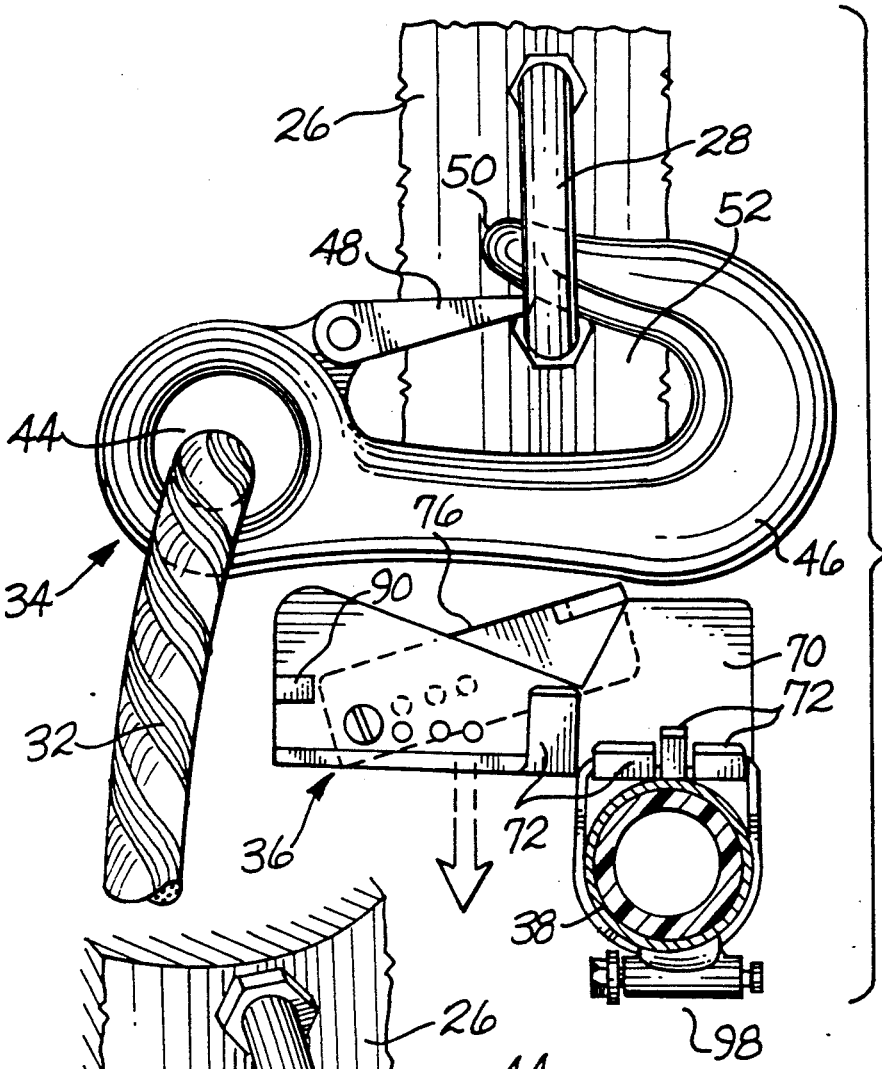
FIG. 7 is a view like FIG. 6, but showing the hook and bow eye in engagement and showing the hook holder being moved away from the hook and the bow eye.

As is known per se, the snap finger 48 is spring biased into the position shown by FIG. 7, by a spring 54. Spring 54 includes a pair of eyes 56 which are positioned on opposite sides of a lug 58 that projects outwardly from a side boundary of the hook eye 44. A securement pin 60 extends through the eyes 56 and through an opening 62 in the lug, and secures the spring 54 to the hook body. Spring arms 64 are located within a channel portion of the snap finger 48.

Figures 2, 9, 10:
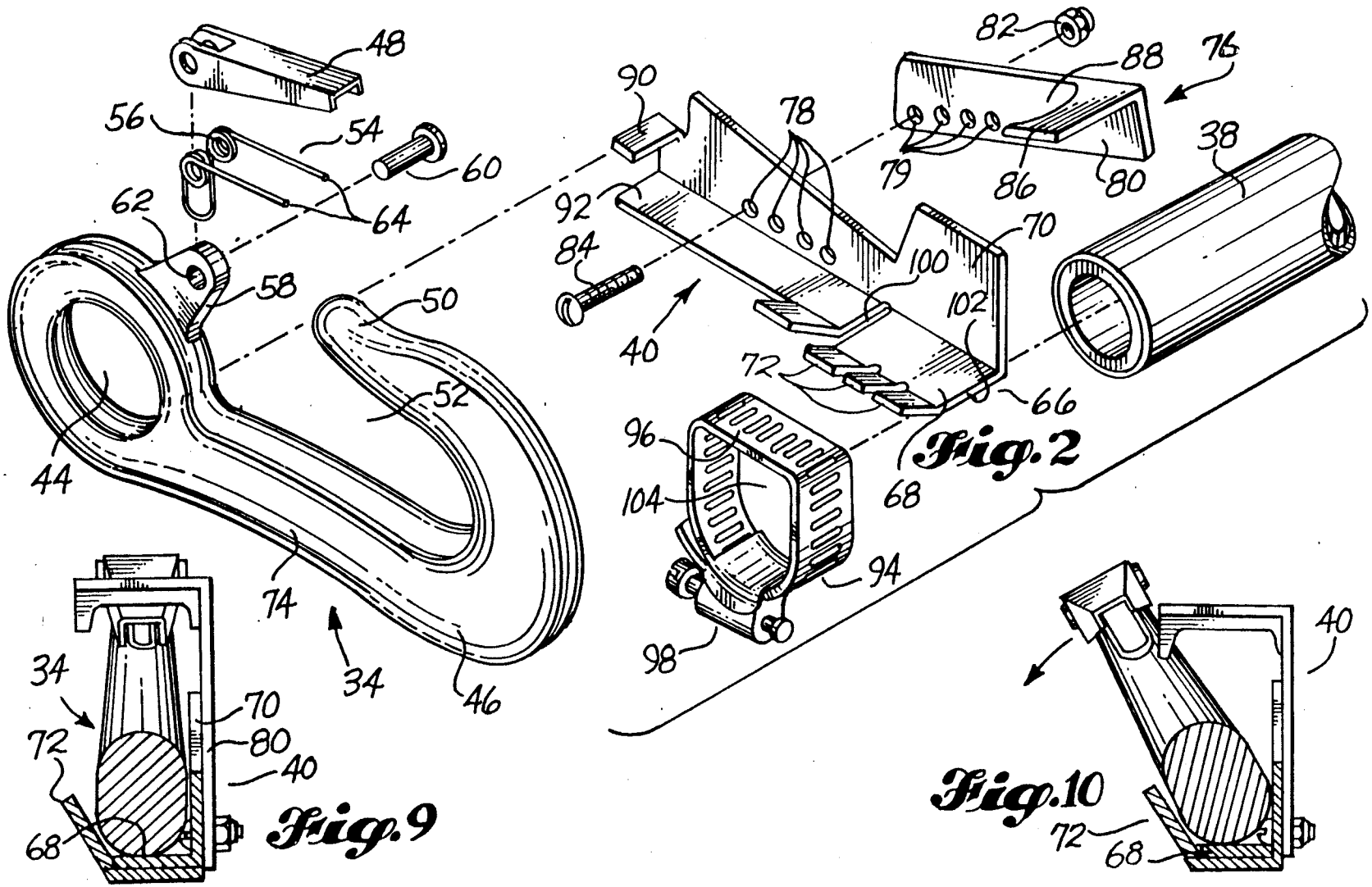
FIG. 2 is an exploded pictorial view of the end portion of a hook holder and a conventional snap-hook, such view showing an end portion of a pole to which the hook holder is connected.
FIG. 9 is a sectional view taken substantially along line 9—9 of FIG. 5, showing the holding arm both holding the snap finger open and holding the hook on the hook holder.
FIG. 10 is a view like FIG. 9, following a release of the holding arm, such view showing the hook freed for easy removal from the hook holder.

Hook holder 40 includes a base channel portion 66 (FIG. 2) in which a back portion of the snap-hook 34 is received (FIGS. 9 and 10). The channel includes a bottom wall 68, a sidewall 70 and side barriers 72. The relatively straight back portion 74 of hook 34 sets on bottom 68 in a position between sidewall 70 and side barriers 72. A holding arm 76 is pivotally attached to hook holder 40. In preferred form, a plurality of bolt holes or openings 78 are provided in sidewall 70. Another plurality of bolt holes or openings 79 are provided in a sidewall 80 of holding arm 76. A nut and bolt assembly 82, 84 secures the holding arm 76 to sidewall 70. One of the openings 79 in the holding arm 76 is aligned with one of the openings 78 in sidewall, 70. Then, bolt 84 is moved through the aligned openings 78, 79 and the nut 82 is attached to its end. The provision of a plurality of openings 78, 79 provides an easy way of adjusting the position of the holding arm 74 on the sidewall 70. This provides a way of adjusting the hook holder 40 for accommodating different size hooks 34. Holding arm 76 includes a hook 86 which extends perpendicular from wall 80. Hook 86 includes a hook notch or recess 88.

Figure 3:
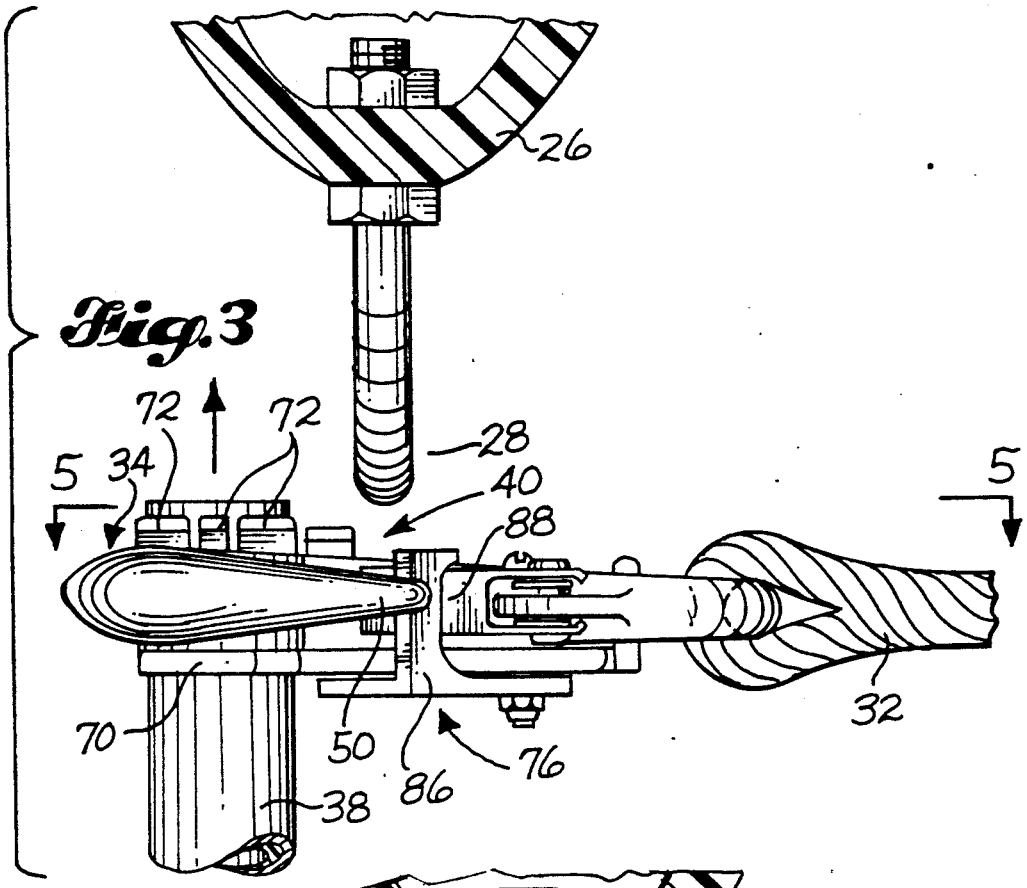
FIG. 3 is a fragmentary top plan view showing the snap-hook in the hook holder and showing the hook being moved towards a bow eye on a boat.
Figure 5:
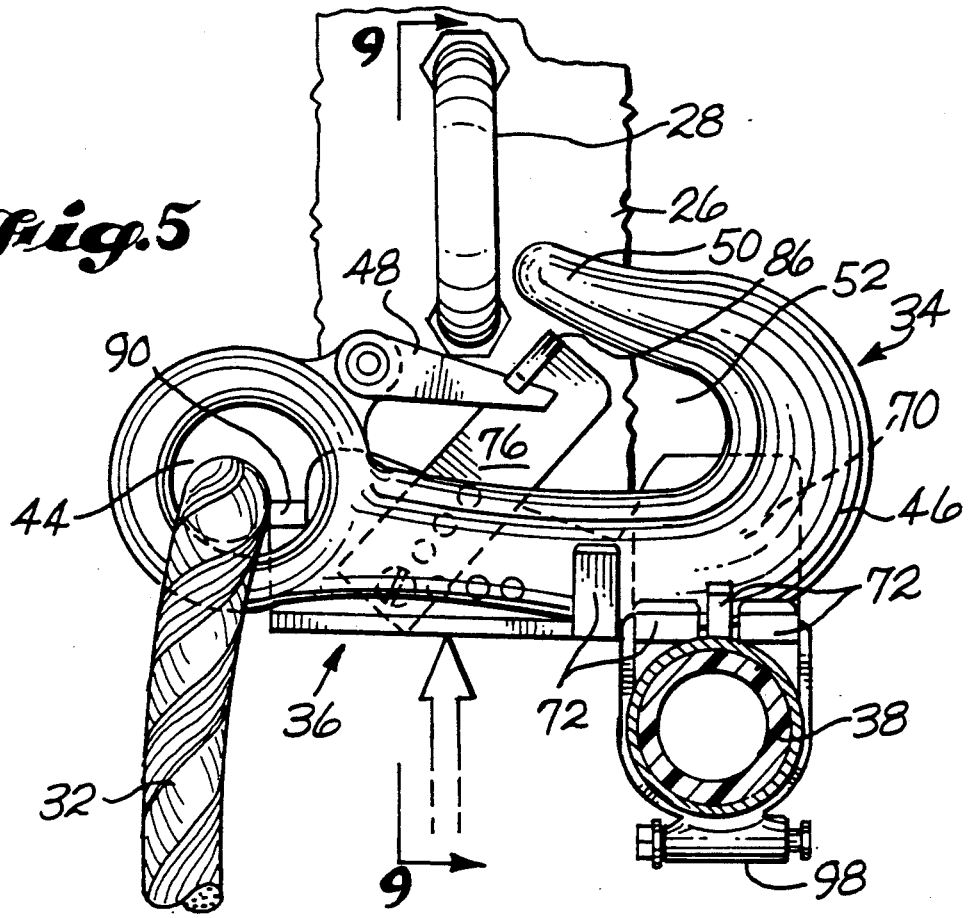
FIG. 5 is a fragmentary elevational view, looking towards the bow eye, such view being taken substantially from the aspect of line 5—5 in FIG. 3, but showing the hook and pole reversed from side to side.
Figure 6:
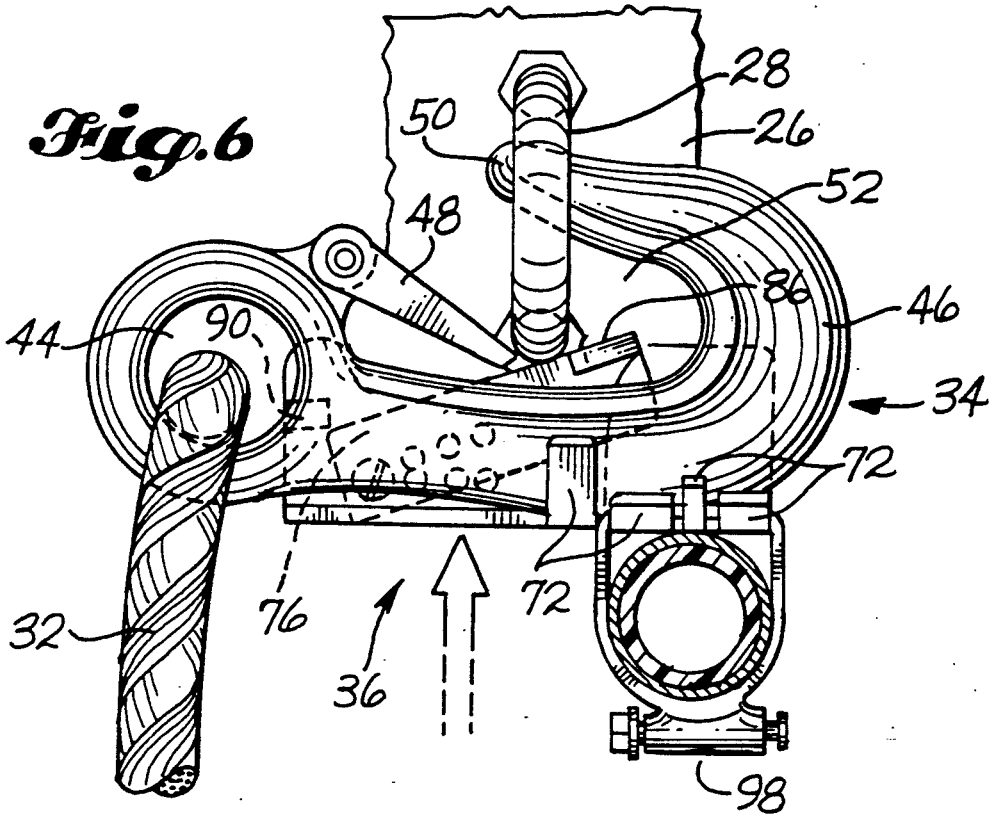
FIG. 6 is a view like FIG. 5, but showing the bow eye entering the hook throat and unlocking the lock lever on the hook holder.

As best shown by FIGS. 5 and 9, a hook 34 may be secured to the hook holder 40 in the following manner. The relatively straight back portion 74 of the hook 34 is set into the channel 66 formed by the bottom 68, sidewall 70 and side barriers 72. This is shown in FIG. 6. The hook is oriented so that its general plane is substantially parallel to the sidewall 70 and the sidewall 80 of holding arm 76. The hook 86 of holding arm 76 is moved to place the snap finger 48 within the hook recess 88. This is best shown by FIGS. 3, 5, and 9. As shown in FIG. 9, the hook 34 is trapped against sideways movement. Hook 86 prevents sideways movement of the snap finger 48. The channel formed by 66, 70, 72 prevents sideways movement of the hook body.

Sidewall 70 includes a holding finger 90 which extends from sidewall 70 above end portion 92 of channel wall 68. As shown in FIG. 5, finger 90 extends into the hook eye 44. This engagement of finger 90 with the hook eye 44 prevents endwise movement of the hook 34 relative to the hook holder 40.

Figure 4:
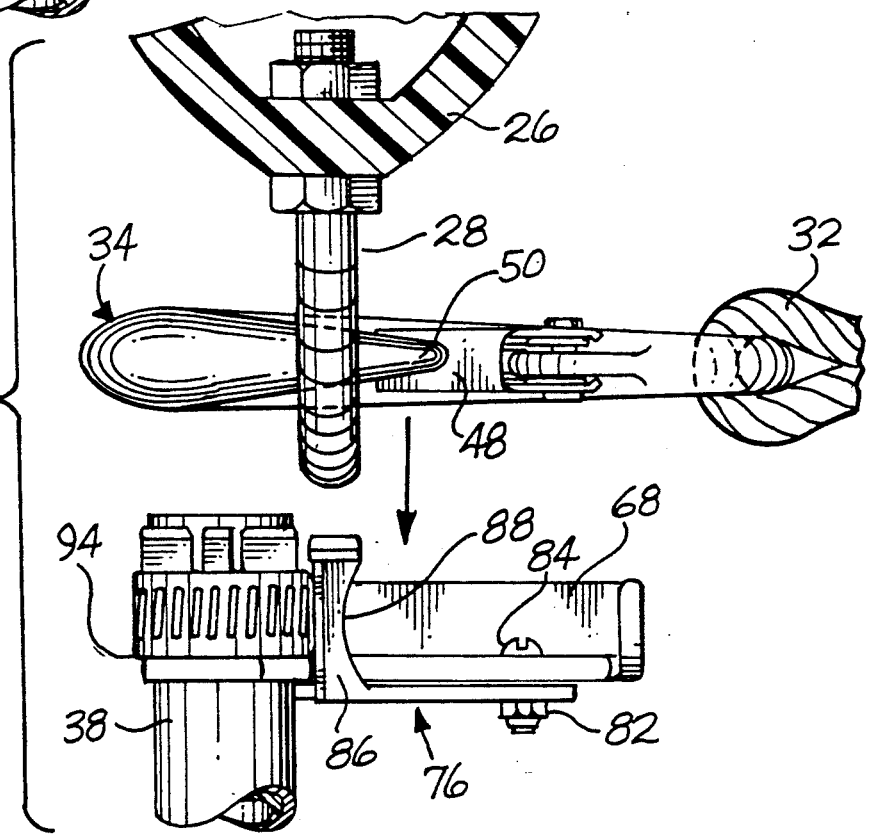
FIG. 4 is a view like FIG. 3, but showing the hook coupled to the bow eye, free of the hook holder, and showing the hook holder being moved away from the bow eye.

FIGS. 3 and 4 show what may be termed a left side arrangement. The pole 38 is on the left of the bow eye 28. The hook throat opens towards the right. FIGS. 5 and 6 show what may be termed a right side arrangement. The pole 38 is on the right side of the bow eye 28 and the hook throat opens towards the left.

The hook holder 40 may be easily secured to the handle or pole 38 by a conventional hose clamp 94, shown in FIGS. 2 and 4–7. A strap portion 96 of clamp 94 opposite an adjustment screw assembly 98 is flattened so that it can fit onto bottom 68 between a slot 100 and an end surface 102. An end portion of pole 38 is then inserted into the clamp eye 104, between bottom 68 and the adjustment screw assembly 98 (see FIGS. 5–7). The adjustment screw assembly 98 is then tightened to draw the strap into a tight binding relationship with the bottom portion 68 and the pole end 38. Of course, there are many different ways in which the hook holder 40 may be secured to the pole or handle 38.

The hook 34 is secured to the hook holder 40 in the manner described. The user U then picks up the handle 38 and uses it to position the hook and hook holder 34, 40 adjacent bow eye 28. The approach of the hook 34 to the bow eye 28 is shown in FIGS. 3 and 5. Referring to FIG. 5, the pole is moved to in turn move the snap finger 48 towards the bow eye 28. Following contact between the bow eye 28 and the snap finger 48, movement of hook 34 towards bow eye 28 is continued. As shown in FIG. 6, the contact swings snap finger 48 downwardly out of its engagement by the hook recess 88. The contact moves the holding arm 76 downwardly. Snap finger 48 clears the eye 28 and is moved by spring 54 into a closed position against the hook end 50 (FIG. 7). As shown by FIG. 10, the repositioning of the hook 86 frees hook 34 for movement out of the hook holder 40. Hook 34 rotates sideways, allowing the hook holder 40 to be pulled away from it. The sideways rotation moves finger 90 out from hook eye 44.

Figure 8:
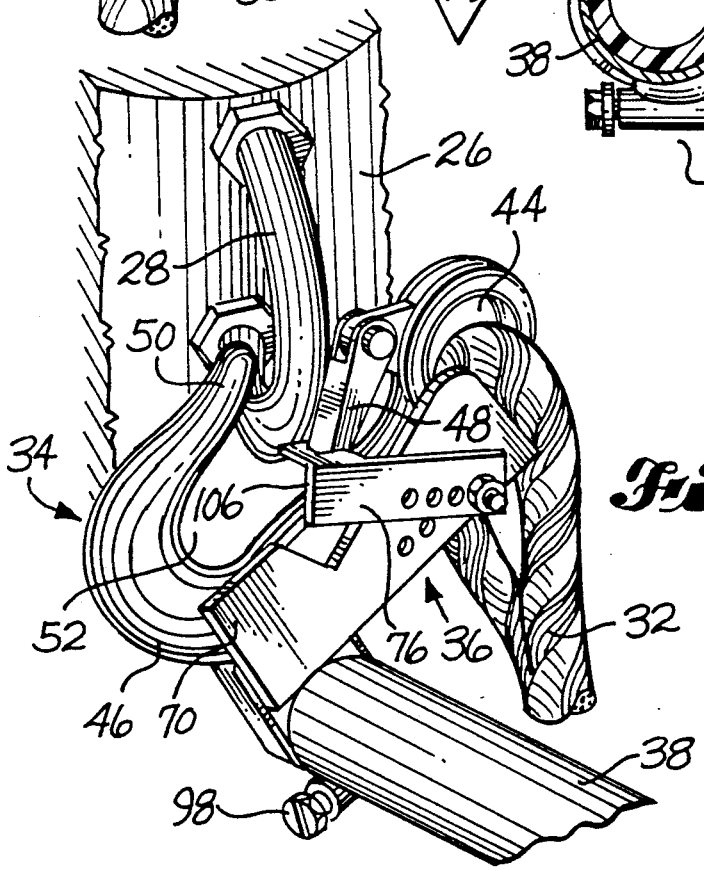
FIG. 8 is a pictorial view of the hook holder and hook being moved toward the bow eye, showing an end extension on the holding arm.

As shown by FIG. 8, sidewall 80 of holding arm 76 may include an endwise extension 106 of sidewall 80. As shown by FIG. 8, this extension prevents a thin bow eye 28 from missing contact with the snap finger 48 and holding arm 76, and entering hook throat 52 through a space between the end of holding arm 76 and the hook tine end 50. Such a thin eye would contact the extension 106 and be moved by it against the snap finger.

The hook holder of the invention can be used for hooking a snap-hook to an eye or ring that is on something other than a boat. The illustrated embodiment is provided as an example of the invention. The scope of protection is not to be determined by the disclosed embodiment, but rather is to be determined by the following claims, interpreted by established rules of patent claim interpretation, including use of the doctrine of equivalents.

What is claimed is:

1. A tool for connecting a snap-hook to a remote eye, said snap-hook including a hook eye, a curved hook tine extending from said hook eye to a free end, a hook throat defined by and between said hook eye and said free end, and a snap finger which normally spans across and closes said hook throat and which is springable inwardly of the hook throat into an open position, said tool comprising:

a hook holder including a channel in which the snap-hook is received, said channel including a bottom wall, a sidewall and side barriers, together forming a channel space, said snap-hook being received in the channel space with the snap finger and the hook throat being positioned above the channel bottom wall, and with the general plane of the snap-hook being substantially parallel with the sidewall of the hook holder;

and a holding arm having a first end portion that is pivotally attached to the hook holder and an opposite end portion which includes a snap finger engaging hook, including a hook recess.

wherein a snap-hook can be placed within the channel of the hook holder and the holding arm can be pivotally moved to place the snap finger of the snap-hook into the hook recess of the snap finger engaging hook of the holding arm, to secure the snap-hook to the hook holder, and wherein the hook holder and snap-hook can be moved to the remote eye, and further move the hook holder and snap-hook to place the snap finger into contact with the remote eye, and further move the hook holder and snap-hook towards the remote eye, to move the snap finger out of engagement with the hook recess of the holding arm, allowing the remote eye to enter into the hook throat, and freeing the snap-hook from the holding arm, and allowing the hook holder to be moved away from the snap-hook following engagement of the snap-hook and the remote eye.

2. The tool of claim 1, wherein the sidewall of the hook holder includes a finger which projects laterally from the sidewall over the bottom wall and into the hook eye, said finger serving to restrain the snap-hook from endwise movement off of the hook holder.

3. The tool of claim 1, wherein the holding arm is adjustably mounted onto the sidewall of the hook holder so that the hook recess can be moved in position to adjust the hook holder to different size snap-hooks.

4. The tool of claim 1, wherein the hook holder is secured to an end of an elongated handle, with the snap-hook holding channel disposed substantially perpendicular to the handle, whereby a user can grasp the handle distal the hook holder and use the handle to move the snap-hook and holder towards the remote eye, to engage the snap-hook with the remote eye, and remove the hook-holder away from the snap-hook, following engagement of the snap-hook with the remote eye.

* * * * *

UNITED STATES PATENT AND TRADEMARK OFFICE

CERTIFICATE OF CORRECTION

PATENT NO. : 5,190,330

DATED : March 2, 1993

INVENTOR(S) : Bill Dunham

It is certified that error appears in the above-identified patent and that said Letters Patent is hereby corrected as shown below:

Column 1, line 24, after "4,923,700", insert -- granted June 12, 1990 to Ronald D. Hart. A principal object --.

Column 3, line 48, delete the comma after "sidewall".

Column 3, line 52, "arm 74" should be -- arm 76 --.

Signed and Sealed this

Fifteenth Day of March, 1994

Bruce Lehman

*Attest:*

BRUCE LEHMAN

*Attesting Officer*

*Commissioner of Patents and Trademarks*